US005620357A

United States Patent [19]

Misaka et al.

[11] Patent Number: 5,620,357

[45] Date of Patent: Apr. 15, 1997

[54] POLISHING METHOD AND APPARATUS FOR AUTOMATIC REDUCTION OF WAFER TAPER IN SINGLE-WAFER POLISHING

[75] Inventors: Hitoshi Misaka; Kouichi Tanaka; Morifumi Matsumoto; Kouji Morita, all of Fukushima-ken, Japan

[73] Assignee: Shin-Etsu Handotai Co., Ltd., Tokyo, Japan

[21] Appl. No.: 423,252

[22] Filed: Apr. 17, 1995

[30] Foreign Application Priority Data

Apr. 18, 1994 [JP] Japan ..... 6-103398

[51] Int. Cl.[6] ..... B24B 7/22

[52] U.S. Cl. ..... 451/9; 451/288

[58] Field of Search ..... 451/9, 41, 291, 451/290, 289, 288, 285, 5, 11

[56] References Cited

U.S. PATENT DOCUMENTS

| | | | |
|---|---|---|---|
| 4,742,651 | 5/1988 | Wittstock | 451/24 |
| 5,486,129 | 1/1996 | Sandhu et al. | 451/5 |

FOREIGN PATENT DOCUMENTS

| | | |
|---|---|---|
| 1153266 | 6/1989 | Japan . |
| 1193172 | 8/1989 | Japan . |
| 1228773 | 9/1989 | Japan . |
| 2027721 | 1/1990 | Japan . |
| 2159722 | 6/1990 | Japan . |
| 2257628 | 10/1990 | Japan . |

*Primary Examiner*—Robert A. Rose
*Attorney, Agent, or Firm*—Barnes & Thornburg

[57] ABSTRACT

A polishing method and apparatus for reducing wafer taper in single-wafer polishing are disclosed, by which the whole processes from measurement of thickness profile of wafers and polishing thereof are fully automated and the working efficiency is not only improved, but also the polished wafers are produced with high accuracy in reduction of the taper thereof.

The present invention is executed as follows: Thickness profiles of a wafer is measured with a measurement instrument of thickness in X,Y direction mutually perpendicular, and the taper T and stock removal $S_0$ are determined from the thickness profiles with the method of least squares by a CPU and further the eccentricity δ, which is the distance between the center of the wafer and that of pressing force, is determined with the help of an equation $$\delta = T.R/8.S_0,$$

where R is the radius of the wafer, by the CPU. The wafer is then transferred onto a positioning plate placed on an X,Y stage and the wafer is positioned at the position corresponding to the eccentricity δ supplied from the CPU by means of operation of the X,Y stage to finally be fixed on the positioning plate. The wafer, which is fixed thereon, is pressed on a polishing pad and polished, while the wafer is rotated about its center, the polishing table of a means for rotation and reciprocation thereof is rotated and reciprocated relative to its original position to give the wafer the relative revolutional motion and polishing slurry is constantly supplied. Thereafter, the thickness profiles of the as-polished wafer are again measured and at that point, if the taper is not reduced within the specification therefor, the second eccentricity δ is determined to obtain modified polishing conditions for a corrective single-wafer polishing.

17 Claims, 8 Drawing Sheets

FIG. 5

| | | STOCK REMOVAL | |
|---|---|---|---|
| | | SHORT | PROPER |
| TAPER | YES | B | E |
| | NO | C | F |
| | YES (REVERSE) | D | G |

POLISHING METHOD AND APPARATUS FOR AUTOMATIC REDUCTION OF WAFER TAPER IN SINGLE-WAFER POLISHING

BACKGROUND OF THE INVENTION

1. Field of the Invention

The present invention relates to a polishing method and apparatus for automatic reduction of taper of a wafer in single-wafer polishing, said method and apparatus being suitable for automatically polishing semiconductor wafers one at a time so as to be flat and free of taper through such processes as lapping and mechano-chemical polishing (hereinafter referred to as polishing).

2. Description of the Prior Art

Generally, wafers are obtained by cutting a single crystal rod as a slice. The thus obtained wafers are further processed in a series of processes, such as beveling, lapping, etching, sandblasting, elimination of donors of silicon-oxygen complexes and the like and still further mirror-finished by polishing and then being cleaned to be final products.

As shown in FIGS. 6 and 7, a majority of wafers 9 with a radius R forwarded to the polishing process have a taper 34 and thus the polishing process needs a kind of polishing, in which reduction of taper is carried out at the same time. Moreover, the wafer 9 is not an exactly circular disk, but has an orientation flat 35 (hereafter referred to as OF 35) formed in part of the periphery thereof as also shown in FIG. 6. Conventionally a variety of polishing methods were developed and tested, since taper was difficult to be reduced when wafers were polished only by being pressed to a polishing pad, in particular, under the influence of the taper 34 and OF 35.

On the other hand, there was a conventional multi-wafer polishing method as a method for polishing wafers 9, in which a plurality of wafers 9 are polished at the same time. In the recent trend that requires increase in the diameter and improvement on dimensional accuracy in processing, the single-wafer polishing method has been more popular, in which method wafers are polished one at a time.

A means was adopted so as to be free of taper in the single-wafer polishing method, which is shown in FIG. 8. The means is to bias the center of pressing load from the center of a wafer 9 by a eccentricity of δ. It has been not only theoretically but also experimentally proved that the taper 34 is eliminatable by this means.

As shown in FIG. 9, the relation of the eccentricity δ and the taper T of a wafer is expressed by a equation $$\delta = T.R/8.S_0,$$

where $S_0$ is a stock removal by polishing off. The relation between the eccentricity δ and the taper T is linear, when the stock removal $S_0$ is constant and the radius is selected as a parameter.

There is known a disclosure in First Publication of Patent Application HEI No. 2-159722 as one of the prior art in regard to finish by polishing based on the theory above-mentioned. The polishing apparatus for wafers and the positioning device used therefor according to the disclosure have especially such a structure of the device that: wafers as works are held on a X,Y stage; a side of a mounting head, on which wafers to be held by suction is joined with the X,Y stage; the mounting head is positioned relative to the center of the pressing load in such a place that it has a predetermined eccentricity by adjusting a micrometer installed on the X,Y stage, where the position of the mounting head is determined by the displacements thereof in the directions X and Y mutually perpendicular; and the wafers on the X,Y stage are transferred by again being suctioned onto the surface of the mounting head.

Taper of a wafer may be reduced according to the above-mentioned prior art, but the disclosed technology is only fundamental in regard to reducing taper of a wafer in polishing process, for a technology, in which wafers are mounted on a surface of the mounting head with a predetermined eccentricity, is detailed therein without a suggestion on any improvement beyond the fundamentals. The exact positioning of wafers, which serves polishing of high accuracy, may be difficult and time-consuming in the case of multi-polishing according to the disclosure, since the adjustment has to be made manually. More particularly, there remain a problem of poor positioning accuracy, that is, positioning accuracy of the X,Y stage and much of time-consuming steps such as respective determinations of eccentricity of wafers and positioning of the wafers and therefore, in light of the just-mentioned adversaries the prior art has a plurality of problems to be solved before being put to practical use.

The present invention has an object to provide a method and an apparatus for polishing to reduce or eliminate taper of wafers in single-wafer polishing by automation of steps of measurements of taper and polishing of wafers including amendments of conditions for further eliminating taper in corrective polishing. To determine the eccentricity of a wafer according to the prior art, there is a fundamental difficulty, which means that the eccentricity should be computed by the equation $$\delta = T.R/8.S_0,$$

after the taper of a wafer T and a stock removal $S_0$ is obtained but the eccentricity δ is actually difficult to determine, since the thickness profile in the directions X,Y mutually perpendicular is changeable along the respective directions with complexity. The prior art does not practically disclose any means to solve this particular problem.

SUMMARY OF THE INVENTION

The present invention was made in view of the problems in the above-mentioned prior art technology and has objects to provide a method and an apparatus with automation of all the processes from measurement of the thickness profile of a wafer to polishing and to provide the method and the apparatus for polishing to automatically reduce taper of wafers in single-wafer polishing, said method and said apparatus for polishing being efficient, practically usable and besides capable of wafer polishing with high accuracy at a low cost by concretizing how to determine an eccentricity from the thickness profile data of a wafer measured.

The polishing method for reducing wafer taper in single-wafer polishing according to one embodiment of the present invention, where wafers 9 are polished to be flat by pressing wafers 9 one at a time on a polishing pad 29 and reducing the taper of the wafer 9, is characterized in that the taper T and stock removal $S_0$ of a wafer 9 are computed based on X,Y directions mutually perpendicular thereof; an eccentricity δ that is the distance between the center of the wafer 9 and the center of pressing load is automatically computed on the basis of T and $S_0$; the wafer 9 is mounted automatically on an X,Y stage 5 and again automatically positioned by the eccentricity δ to be fixed there keeping the geometrical relation with the center of a wafer suction plate 21; and mirror-polishing of the wafer 9 is proceeded being pressed on a polishing pad 29 under continuous supply of polishing slurry, while the wafer 9 turns about its own center and revolves relatively around the center of the polishing pad 29, where the polishing pad 29 is rotating about the center and at the same time reciprocating horizontally relative its own original position together with the same motions of a polishing table 28, on which the polishing pad 29 is fixedly attached.

The polishing method for reducing wafer taper in single-wafer polishing according to another embodiment of the present invention is characterized in that the method of least squares is applied to approximately determine a taper T and stock removal $S_0$ from the data of the thickness profile of a wafer 9.

The polishing apparatus for reducing wafer taper in single-wafer polishing according to a further embodiment of the present invention, where wafers 9 are pressed one by one on a polishing pad 29 to reduce the taper practically to zero and at the same time make the surface flat by polishing, comprises: a measurement instrument of thickness 3 for measuring thickness profiles in X,Y directions mutually perpendicular of a wafer 9; a central processing unit (hereinafter referred to CPU) 1 for obtaining the taper T and stock removal $S_0$, further computing and recording the eccentricity δ between the center of the wafer 9 and the center of pressing load based upon the taper T and stock removal $S_0$ obtained and lastly providing a control means 2 with the eccentricity δ while polishing; a robot 4 for setting a wafer 9, which is taken out of a cassette, in place on a positioning plate 13; an X,Y stage 5, on which the positioning plate 13 is placed, and automatically positioning the wafer 9 at the position corresponding to the eccentricity δ; a first device 6 for holding by suction, pressing and rotating the wafer 9 equipped with a wafer suction plate 21 for holding the wafer 9 and at the same time providing the wafer 9 with pressing force and rotation; a second device 7, which contacts with the wafer suction plate 21, for rotating and reciprocating a polishing table 28 having a polishing pad 29 fixedly disposed on the surface, the polishing table 28 being rotatable around its center axis to provide a relative revolutionary motion for the wafer 9; a third device 8 for supply of polishing slurry to the contacting surfaces of the wafer 9 and the polishing pad 29; and a controlling means 2 for receiving the eccentricity δ from a CPU 1 and automatically control the constituents above mentioned of the polishing apparatus.

The polishing apparatus for reducing wafer taper in single-wafer polishing according to a further embodiment of the present invention is characterized in that the method of least squares is applied to approximately determine a taper T and stock removal $S_0$ on the basis of the thickness profile data of a wafer 9.

The polishing apparatus for reducing wafer taper in single-wafer polishing according to another embodiment of the present invention is characterized in that a measurement instrument of thickness 3 comprises: a table 10 mounting a wafer 9; a digital out put device 11 for thickness profile data of the wafer 9, which is placed on the table 10, measured in X,Y directions mutually perpendicular, said thickness profile data being automatically provided to a CPU 1 as input data.

The polishing apparatus for reducing wafer taper in single-wafer polishing according to another embodiment of the present invention is characterized in that a CPU 1 receives the thickness profile data in X,Y directions mutually perpendicular from a measurement instrument of thickness 3, computes and memorizes the eccentricity δ and then provides the same eccentricity δ for a control means 2 when the wafer 9 is polished.

The polishing apparatus for reducing wafer taper in single-wafer polishing according to a further embodiment of the present invention is characterized in that a CPU 1 has a function to revise an eccentricity δ and to adjust polishing conditions based upon a second measurement of the thickness profile data of a wafer 9 that has been mirror-finished.

The polishing method or the operation of or between the constituents of the apparatus of the present invention are here outlined: A wafer is mounted on a measurement instrument of thickness to measure a thickness profile in X,Y directions thereof. The data of the thickness profile are input to a CPU. The CPU computes the taper T and stock removal $S_0$ and determines and memorizes the eccentricity δ according to the equation $$\delta = T.R/8.S_0$$

under the application of the method of least squares. The wafers are returned to a cassette after the measurement of the thickness profile and set in place by the wafers in a cassette in a single-wafer polishing apparatus. The wafers are then transferred from the cassette one by one by means of a robot onto a positioning plate on an X,Y stage and fast held there after being positioned in regard to the OF. An actuator attached to the X,Y stage displaces the wafer and finishes positioning of the same wafer by the eccentricity δ as received as an signal from the CPU following the instruction from the control means. In succession to the positioning, a mounting head, which carries a wafer suction plate, is moved to a position above the positioning plate, then the wafer suction plate goes down to hold by suction thereon the wafer already fixed on the positioning plate maintaining the eccentricity as determined in reference to the center of the wafer suction plate and transports the same wafer as held thereon to a predetermined position on a polishing table. The wafer is pressed onto a polishing pad on the polishing table by a predetermined pressing force and at the same time is rotated about its center, while the polishing pad is rotated about its central axis to eventually have the wafer revolving around the same central axis. The polishing of the wafer is going on for a predetermined period of time under the constant supply of polishing slurry to the surface of the same wafer contacting a part of the polishing pad, while reducing the taper to almost nil. The wafer is again measured a thickness profile after the first polishing and the data is input to the CPU so as to be used as the basis for the following corrective polishing.

BRIEF DESCRIPTION OF THE DRAWINGS

Other features and objects of the present invention will become apparent from a study of the following description of a polishing method and a polishing apparatus for automatic reduction of taper of a wafer in the single-wafer polishing, said method and said apparatus being suitable for automatically polishing semiconductor wafers one at a time so as to be flat and free of taper through such processes as lapping and polishing, together with the accompanying drawings, of which:

FIG. 5 is a table illustrating sectional views of polished wafers of the examples of the present invention and the comparison tests therewith;

FIG. 6 is a plan view of a wafer with an OF;

DETAILED DESCRIPTION OF THE PREFERRED EMBODIMENTS

Figure 1:
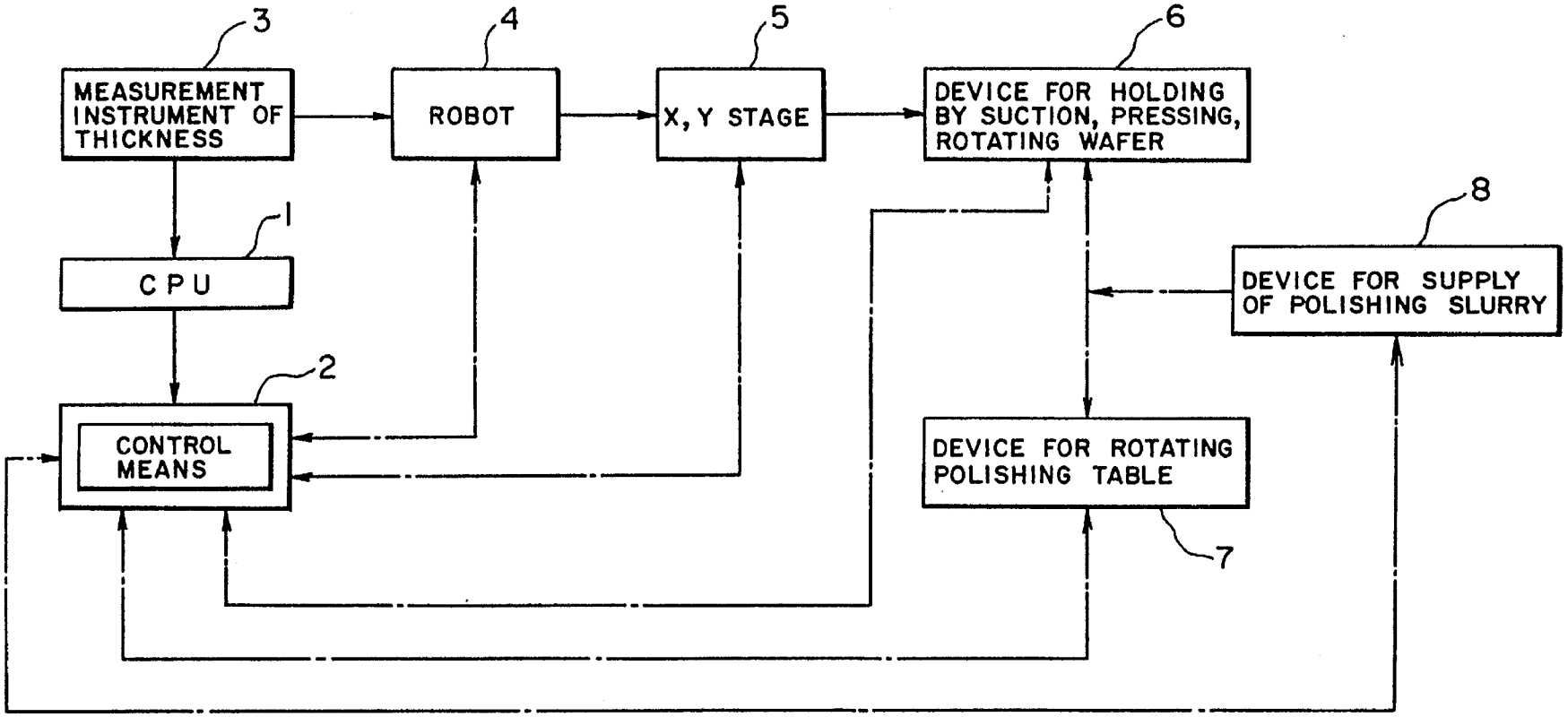
FIG. 1 is a general block diagram of the polishing apparatus of the present invention, the blocks each indicating a constituent of the same apparatus.
Figure 2:
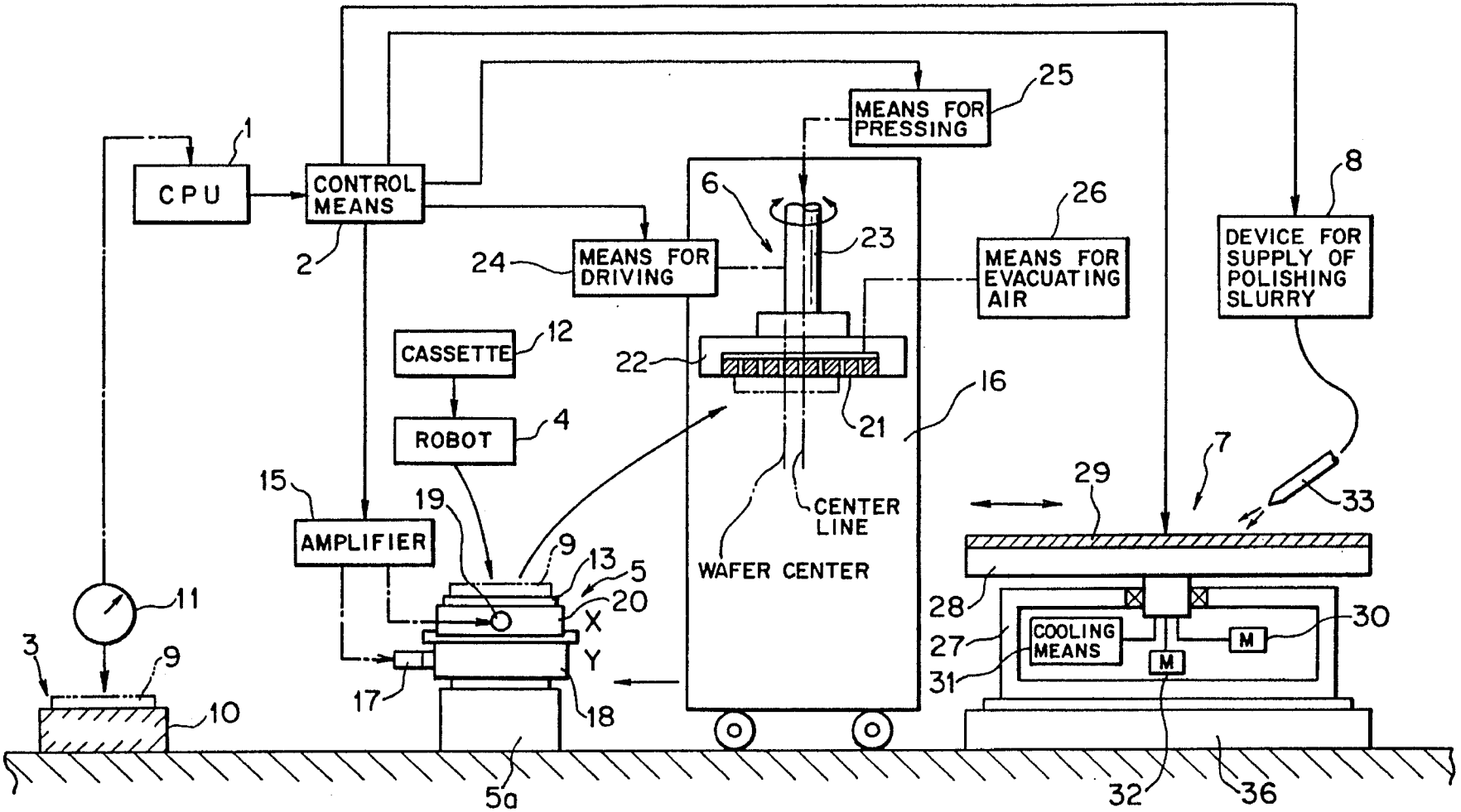
FIG. 2 is a simplified schematic representation of the polishing apparatus and CPU control system in the preferred embodiment of the present invention.
Figure 4:
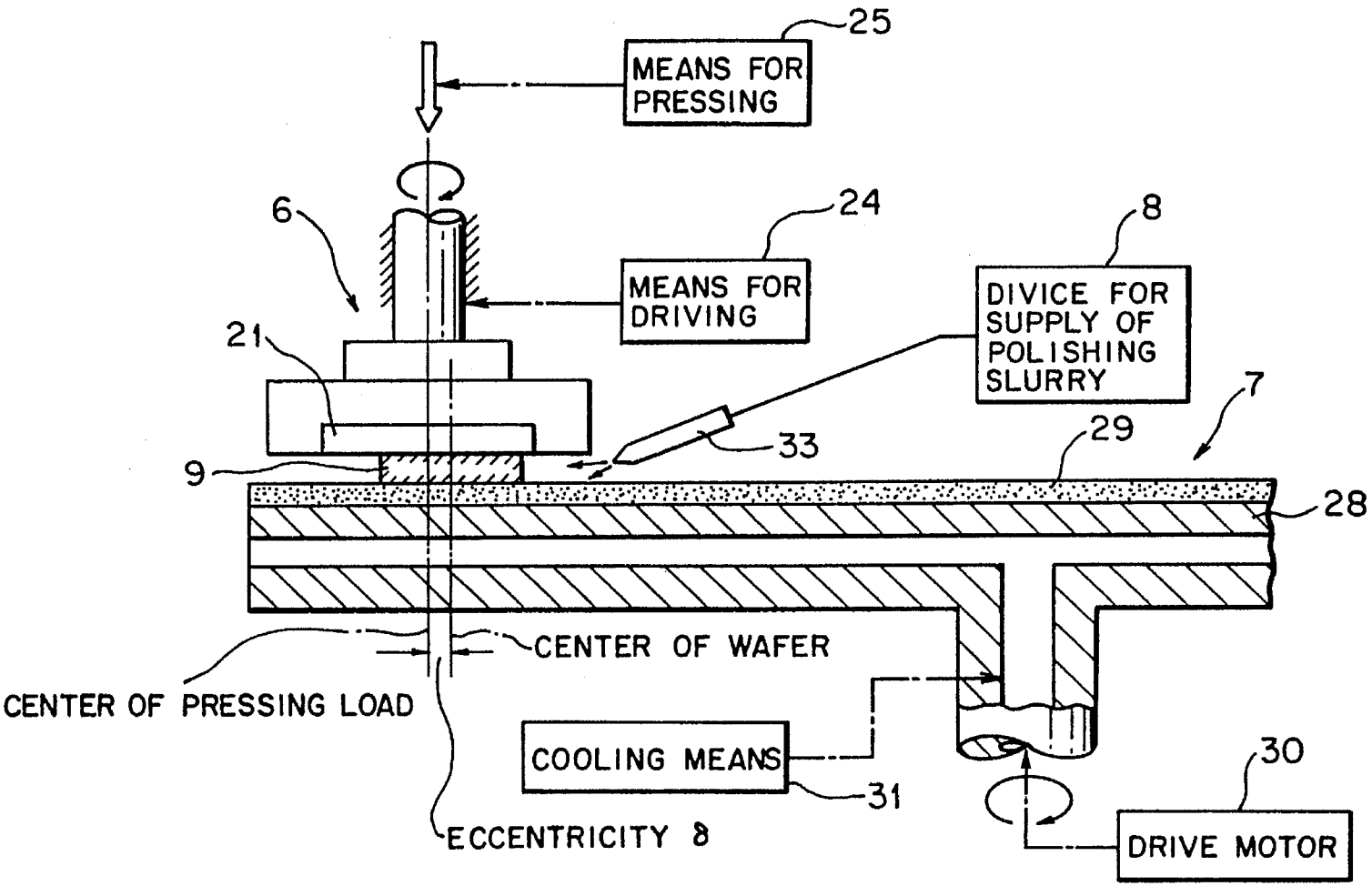
FIG. 4 is a fragmentary schematic illustration in section of the polishing related parts combined with block diagram.
Figure 6:
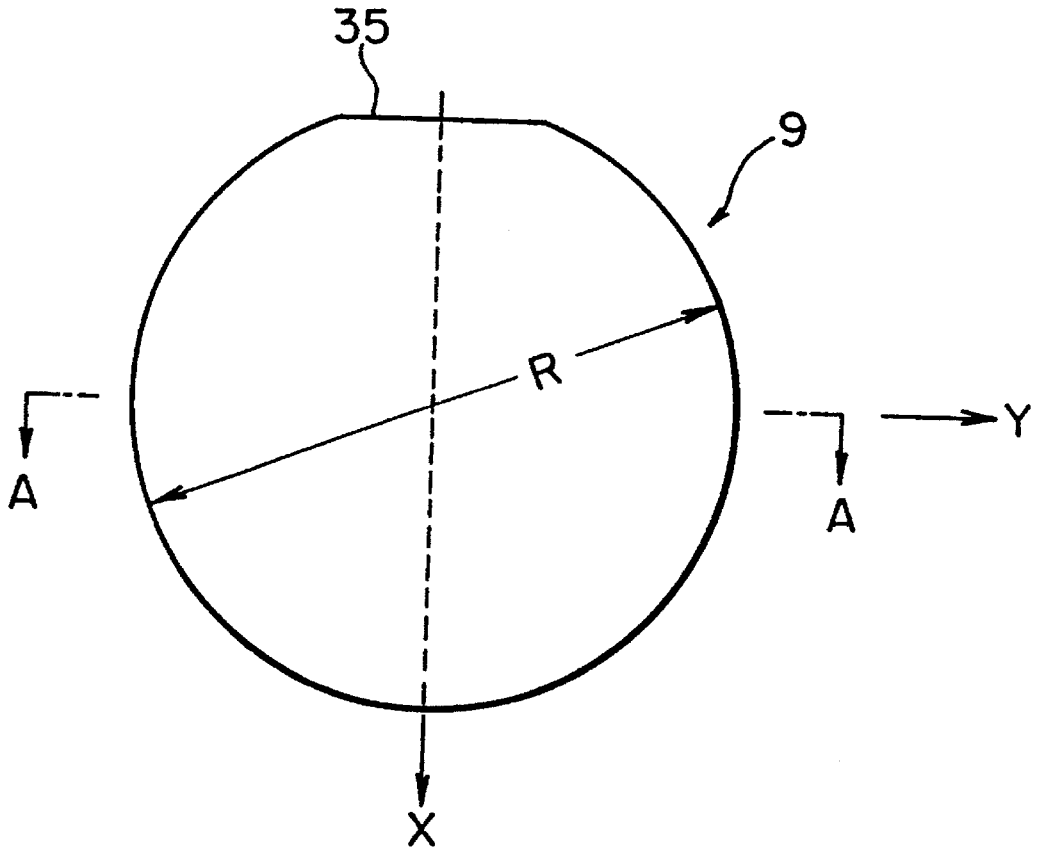
Figure 7:
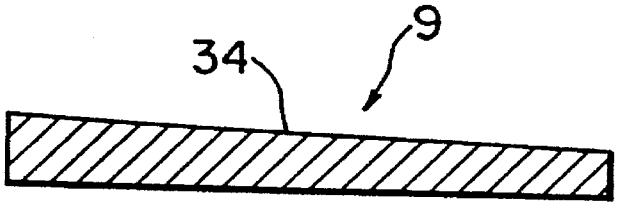
FIG. 7 is a sectional view taken along the line A—A of FIG. 6.
Figure 8:
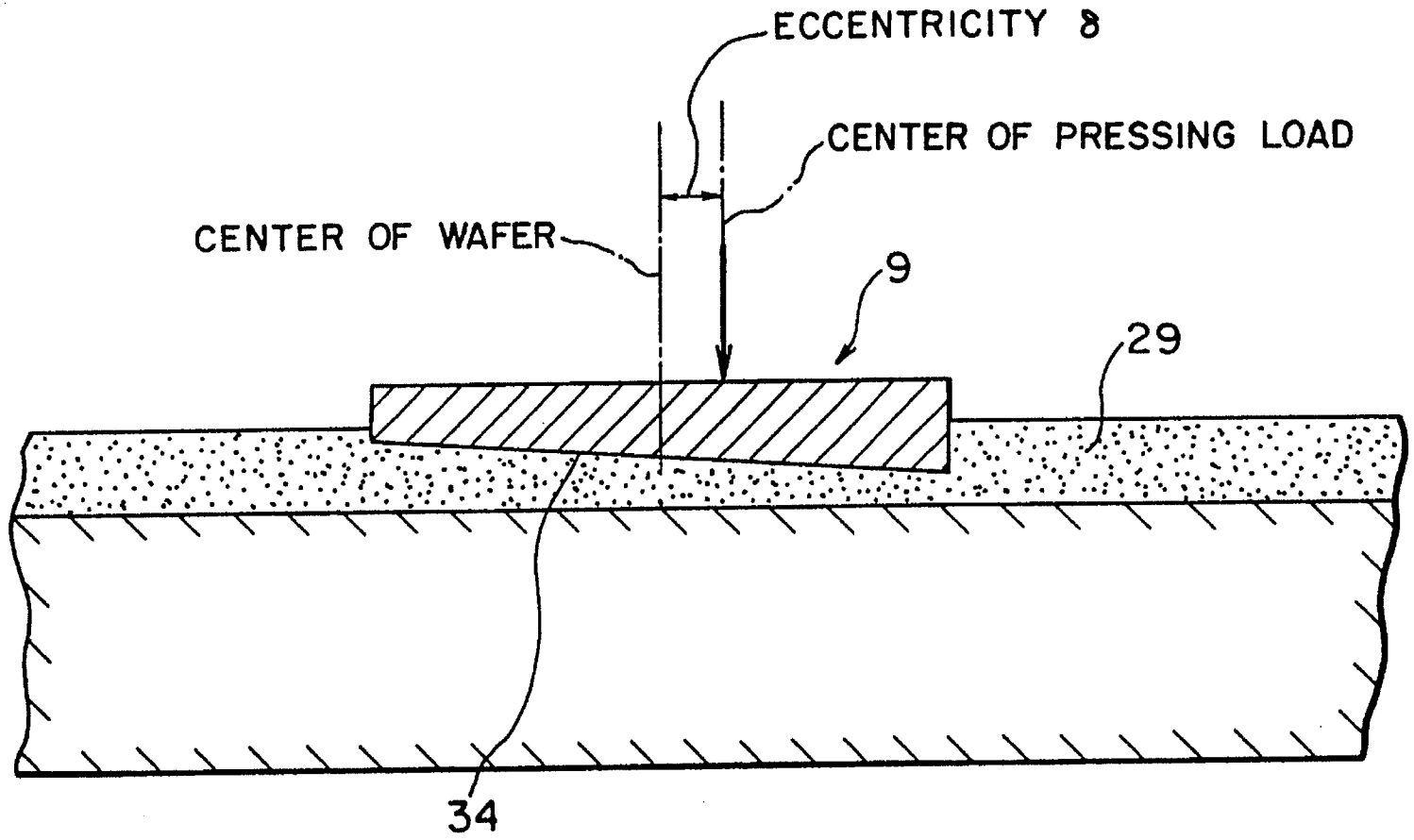
FIG. 8 is a schematic sectional representation of the working principle operating in the course of reducing wafer taper by polishing in the single-wafer polishing according to the present invention.
Figure 9:
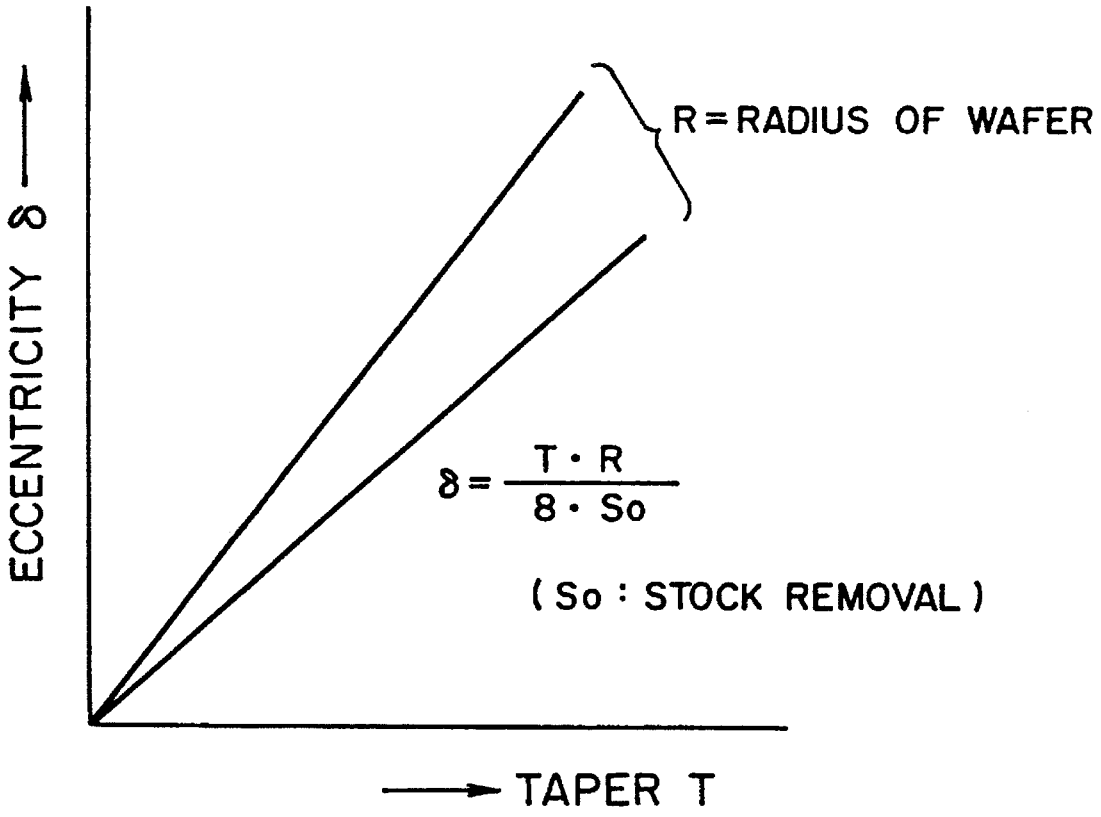
FIG. 9 is a graph showing the linear relation between the eccentricity δ and the taper T of an as-polished wafer according to the present invention.

An embodiment of the present invention will be described below in reference to the drawings:

FIG. 1 is a general block diagram of the polishing apparatus of the present invention, the blocks each indicating a constituent of the same apparatus. FIG. 2 is a simplified schematic representation of the polishing apparatus and CPU control system in the preferred embodiment of the present invention. FIG. 4 is a fragmentary schematic illustration in section of the polishing related parts combined with block diagram. FIG. 5 is a table illustrating section views of polished wafers of the examples of the present invention and the comparison tests therewith.

First of all, the theoretical base in the embodiment of the present invention will be explained. As described above, the desired eccentricity is obtained by the following equation (1):

$$\delta=T.R/8.S_0 \quad (1)$$

, where T is the taper as measured of a wafer, R is the radius thereof, $S_0$ is a stock removal.

Now, how to determine the taper T and the stock removal $S_0$ be described in a simple manner. If a position on the dotted line with an arrow in the X direction is indicated as X and the thickness at X is indicated as Y, then the relation among X,Y, a taper T and the adjustment of a stock removal $S_0'$ is approximately represented by the following equation (2):

$$Y=T.X+S_0' \quad (2)$$

According to the method of least squares, T is obtained by the following equation (3), while the relation between a stock removal and the adjustment of a stock removal is represented by the equation (4).

$$T=\Sigma(X-\bar{X})^2/\Sigma(X-\bar{X})(Y-\bar{Y}) \quad (3)$$

, where $\bar{X}$ and $\bar{Y}$ are respectively the averages of the distances of measuring points and the measurements of thickness.

$$S_0=S_{01}+S_0' \quad (4)$$

, where $S_{01}$ is: the stock removal as per a polishing instruction, $S_0'$ is the adjustment of a stock removal.

If the taper of a wafer in the Y direction and the stock removal $S_0$ are obtained, as a whole, the two eccentricities in the X and Y directions are respectively determined.

Next the constituents of the polishing apparatus for reducing wafer taper as an embodiment of the present invention will be described in reference to FIGS. 1 and 2. As shown in FIG. 1, the apparatus comprises mainly the following constituents: that is, a CPU 1 communicating with a control means 2, a measurement instrument of thickness 3, a robot 4, a X,Y stage 5, an first device 6 for holding by suction, pressing and rotating a wafer, a second device 7 for rotating a polished pad and a third device 8 for supply of polishing slurry.

The measurement instrument of thickness 3 comprises a table 10 on which a wafer 9 is placed and a digital out put 11, which measures the thickness profiles in the X,Y directions mutually perpendicular of the wafer 9 on the same table 10 and which provides automatically each of the data for the CPU. The measurement instrument of thickness 3 and the digital out put 11 are selected from those disclosed to the public.

The robot 4 transports a wafer 9 taken out a cassette onto the positioning plate 13 installed on the X,Y stage 5.

The CPU 1 computes and records the eccentricity δ by means of the equations (1), (2), (3) and (4) as explained above and transmits the computed eccentricity δ to the control means 2, when the wafer polishes, where the control means 2 adopts a sequential control. The control means 2, which communicates with the CPU 1, adjusts the position of the X,Y stage 5 by way of an amplifier 15 and at the same time runs automatic control of the system comprising the measurement instrument of thickness 3, the robot 4, the first device 6 for holding by suction, pressing and rotating a wafer, the second device 7 for rotating a polishing table, the third device 8 for supply of polishing slurry and the like.

As will be described later, the CPU 1 computes the second eccentricity δ based on the second thickness profile data of the wafer 9 that has been polished and controls the second polishing conditions with the second eccentricity δ applied so as to be of less taper in the corrective polishing of the wafer 9.

The X,Y stage 5 comprises a Y-axis table 18 driven by a Y-axis actuator 17 for driving along the Y-axis direction on a base 5*a*, an X-axis table 20 driven by an X-axis actuator 19 along the X-axis direction on the Y-axis table and the positioning plate 13, which is used for positioning and holding fast the wafer 9 at a predetermined position, placed on the X-axis table 20. The Y-axis actuator 17 and the X-axis actuator 19 are respectively connected with the control means 2 by way of the amplifier 15. A wafer 9 is taken out the cassette 12 by the robot 4, transported to a predetermined position on the positioning plate 13 placed on the X-axis table 20 of the X,Y stage 5 by motions of up or down and turning of the robot 4 as the wafer is held on the same. The first device 6 for holding by suction, pressing and rotating a wafer is moved to the side of the X,Y stage 5 by a means comprising a movable frame 16, which is movable in the left or right directions as viewed in FIG. 2, a driving means, guide rails both not shown and the like and stopped above the predetermined position of the positioning plate 13.

The device for holding 6 by suction, pressing, rotating a wafer is placed inside the movable frame 16 and comprises a suction plate 21 holding a wafer 9 by suction, a mounting head 22 holding the suction plate 21, a rotary shaft 23, a means for driving 24, a means for pressing 25, a means for evacuating air 26 and the like.

The means 7 for rotating the polishing table comprises a housing 27, a rotary table 28 of a large diameter supported by a shaft, a polishing pad 28 attached fast on the rotary table 28, a drive motor 30 for rotating the rotary table 28, a cooling means 31 for cooling the rotary table 28 and the like, another drive motor 32 for reciprocating the means 7 relative to its own original position and a base 36.

The means 8 for supply of polishing slurry comprises a storage tank not shown for storing a chemical polishing slurry including $SiO_2$ and the like, an ejection nozzle 33 for ejecting the chemical polishing slurry to a contacting space between a wafer 9 and the polishing pad 29 and so on.

Now there will be described the physical working of taper reduction of a wafer 9 according to the present invention referring to the simplified schematic representation of the polishing apparatus and CPU control system in the preferred embodiment of the present invention in FIG. 2, the flow chart of the software by which the CPU controls the polishing apparatus so as to reduce the taper of a wafer to almost nil in FIG. 3 and the fragmentary schematic illustration in section of the polishing related parts combined with block diagram in FIG. 4. Thickness profiles in the X,Y directions are measured on a wafer 9 placed on the table 10 (step 100). The thus obtained data of thickness profiles are input to the CPU 1. The CPU 1 computes the taper T and the stock removal $S_0$ by means of the method of least squares from the data input (step 101), further computes the eccentricity $\delta$ based on the equation (1) and then determine the polishing conditions (step 102), while at the same time memorizing the same conditions (103).

The wafer 9 is placed on the positioning plate 13 installed on the X,Y stage 5 by means of the robot 4 and so positioned (step 105) that the center thereof is biased by the eccentricity $\delta$ after the OF is adjusted in place (step 104), through automatic control of the Y-axis actuator and X-axis actuator attached to the X,Y stage 5 by the control means 2 on the basis of the eccentricity $\delta$ computed in the CPU 1.

The movable frame 16, which is loaded with the first device 6 for holding by suction, pressing and rotating a wafer, moves to a predetermined position in relation to the positioning plate 13 and the first device 6 is shifted down to hold by suction the wafer 9 on the suction plate 21. At this point of time, the wafer 9 is fast held on the suction plate 21 with the eccentricity biased from the center of the suction plate 21 (step 106).

Then, the movable frame 16 is moved to a predetermined position relative to the rotary table 28, then the mounting head 22 holding the suction plate 21 is shifted down, while rotating and the wafer 9 is contacted onto the surface of the polishing pad 29 (step 107) under constant supply of polishing slurry onto the rotary table 28, which is rotating and reciprocating. FIG. 4 shows a manner in which a wafer 9 contacting with a polishing pad 29, the center of said wafer 9 being offset by an eccentricity from the center of pressing force. Reduction of taper of the wafer 9 is carried out in single-wafer polishing under set conditions of pressing force, rotational speeds of the wafer and the polishing pad and polishing time, while supplying polishing slurry (step 108).

Now, quality check is done on the wafer as polished in terms of thickness profile (step 109). In case that the as-polished wafer is free or practically free of taper and processed to be within a predetermined allowable range of thickness across the surface thereof, the polishing process finishes as for the same wafer (step 110) and a second wafer 9 enters a single-wafer polishing process.

FIG. 5 is a table illustrating sectional views of as-polished wafers 9 of the examples of the present invention and the comparison tests therewith, where a variety of the states are shown. The sectional views of the wafers as polished do not include as-polished wafers 9 out-of-spec in terms of thickness specification in FIG. 5. The state F is free of taper with a normal stock removal among the states of B, C, D, E, F and G of FIG. 5. The other states than F have a defect each with respect to either taper or stock removal, but they are still correctable to be in-spec in terms of taper with further corrective polishing.

Figure 3:
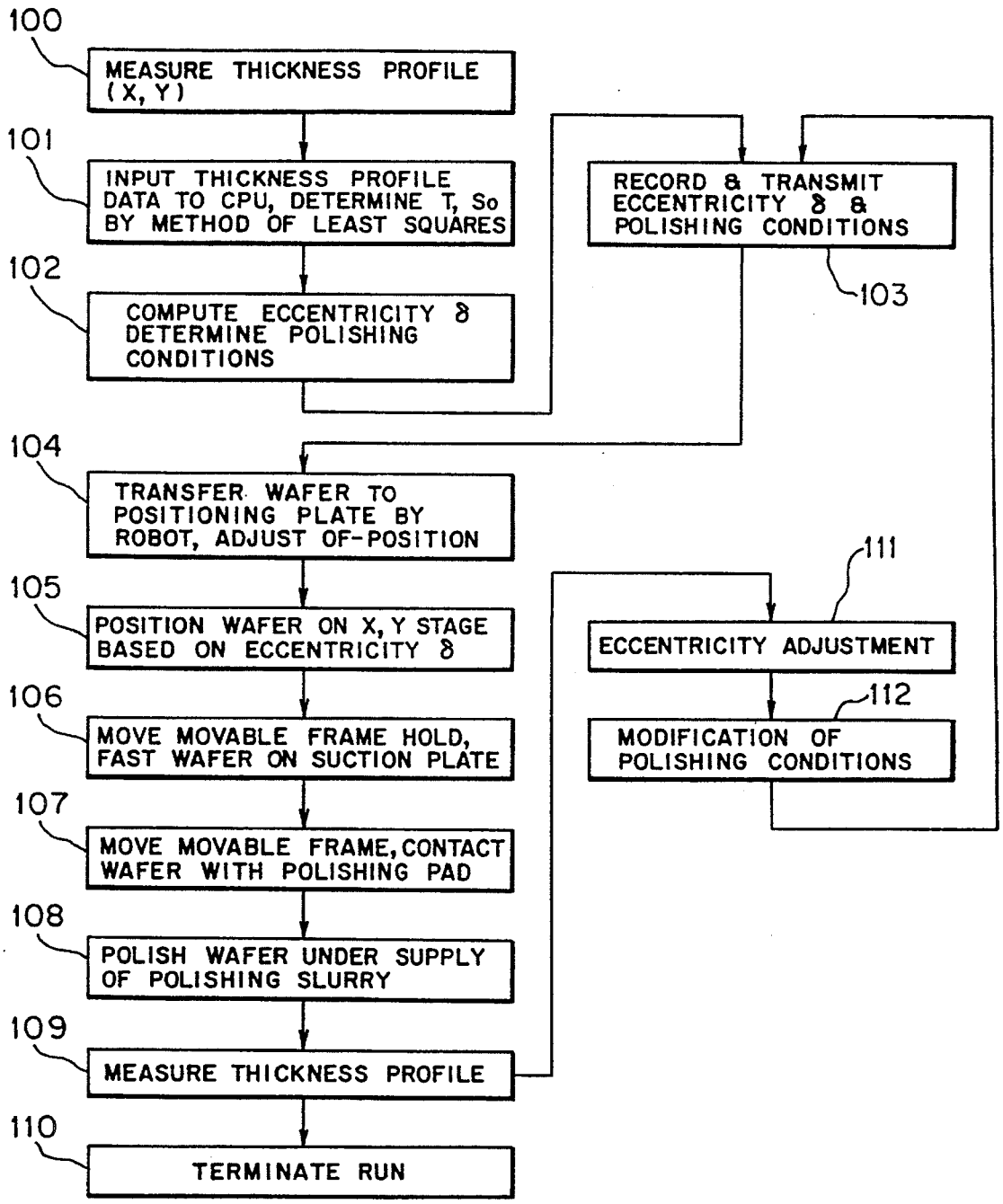
FIG. 3 is a flow chart of the software by which the CPU controls the polishing apparatus so as to reduce the taper of a wafer to almost nil.

On such occasions as out-of-spec in terms of taper and in which further corrective polishing is allowable in regard to thickness specification, adjustment on the eccentricity and modification of the polishing conditions are conducted (step 111) according to the thickness profile data measured (step 109) as shown in the flow chart of the soft ware of FIG. 3. In more concrete terms, the rotational speed of the polishing pad 29 is modified, while adjusting the pressing force, rotational speed, processing period of time of the first device 6 for holding by suction, pressing and rotating a wafer. The polishing process as mentioned above finishes (step 110) as a cycle of corrective polishing.

In this embodiment according to the present invention, a variety of the constituents as those of the polishing apparatus are selected as shown in FIG. 1. The structures of the robot or for positioning a wafer 9 on the positioning plate 21 is not restricted to those illustrated in the drawings accompanied. The polishing method and the polishing apparatus according to the present invention are also applicable to a lapping process, which is relatively much more in stock removal than a polishing process.

The remarkable effects obtained from execution of the present invention are finalized as follows:

1) Shorter operational period of time and higher efficiency is achievable, since the necessary man-power is decreased by means of automation ranged from thickness measurement on a wafer to eccentric polishing applied thereto.

2) Accuracy in taper reduction is improved, since automatic positioning of a wafer with eccentricity is achieved and manual mounting or demounting of the constituents of the polishing apparatus is omitted due to the automation.

3) Polished wafers practically free of taper and in-spec in terms of thickness specification are produced, since taper control is carried out with maintaining the stability and improvement on reduction of taper is materialized by the use of the values of taper and stock removal determined by means of the method of least squares.

4) Remarkable cost reduction in production of polished wafers is achieved, since chances for second polishing of wafers become much more decreased due to improvement on flatness quality of polished wafers accompanied with reduction in the wafer taper achieved by the present invention.

5) Higher accuracy of reduction in wafer taper by single-wafer polishing is efficiently realized through procedures that thickness profile of an as-polished wafer is measured and correction of the eccentricity for the corrective polishing and revision of the polishing conditions are conducted.

What is claimed is:

1. A polishing apparatus for reducing wafer taper in single-wafer polishing, where wafers are pressed one by one on a polishing pad to reduce the taper practically to zero and at the same time make the surface flat by polishing, comprises: a measurement instrument of thickness for measuring thickness profiles in X,Y directions mutually perpendicular of a wafer; a central processing unit (hereinafter referred to CPU) for obtaining the taper T and stock removal $S_0$, further computing and recording the eccentricity δ between the center of the wafer and the center of pressing load based upon the taper T and stock removal $S_0$ obtained and lastly providing a control means with the eccentricity δ while polishing; a robot for setting a wafer, which is taken out of a cassette, in place on a positioning plate; an X,Y stage, on which the positioning plate is placed, and automatically positioning the wafer at the position corresponding to the eccentricity δ; a first device for holding by suction, pressing and rotating the wafer equipped with a wafer suction plate for holding the wafer and at the same time providing the wafer with pressing force and rotation; a second device, which contacts with the wafer suction plate, for rotating and reciprocating a polishing table having a polishing pad fixedly disposed on the surface, the polishing table being rotatable around its center axis to provide a relative revolutional motion for the wafer; a third device for supply of polishing slurry to the contacting surfaces of the wafer and the polishing pad; and a controlling means for receiving the eccentricity δ from a CPU and automatically control the constituents above mentioned of the polishing apparatus.

2. The polishing apparatus for reducing wafer taper in single-wafer polishing claimed in claim 1, characterized in that the method of least squares is applied to approximately determine a taper T and stock removal $S_0$ on the basis of the thickness profile data of the wafer.

3. The polishing apparatus for reducing wafer taper in single-wafer polishing claimed in claim 1, characterized in that a measurement instrument of thickness comprises: a table mounting the wafer; a digital out put device for thickness profile data of the wafer, which is placed on the table, measured in the X, Y directions mutually perpendicular, said thickness profile data being automatically provided to the CPU as input data.

4. The polishing apparatus for reducing wafer taper in single-wafer polishing claimed in claim 1, characterized in that the CPU receives the thickness profile data in the X,Y directions mutually perpendicular from the measurement instrument of thickness, computes and memorizes the eccentricity δ and then provides the same eccentricity δ for the control means when the wafer is polished.

5. The polishing apparatus for reducing wafer taper in single-wafer polishing claimed in claim 1, characterized in that the CPU has a function to revise the eccentricity δ and to adjust the polishing conditions based upon the second measurement of the thickness profile data of the same wafer that has been mirror-finished.

6. A method for reducing wafer taper during single-wafer polishing comprising the following steps of:

computing a taper T and stock removal $S_0$ from measurement of thickness distribution of a wafer;

determining an eccentricity of a center of a pressing load relative to a center of the wafer the basis of T and $S_0$; and polishing the wafer while pressing the wafer with the center of the pressing load at the eccentricity.

7. The method for reducing wafer taper during single-wafer polishing as claimed in claim 6, wherein the measurement of thickness distribution of the wafer is carried out along two perpendicular diameters.

8. The method for reducing wafer taper during single-wafer polishing as claimed in claim 6, wherein the measurement of thickness is carried out with the wafer held on an X,Y stage and the center of the pressing load is successively adjusted with the wafer held on the X,Y stage.

9. The method for reducing wafer taper during single-wafer polishing as claimed in claim 7, wherein the measurement of thickness is carried out with the wafer held on an X,Y stage and the center of the pressing load is successively adjusted with the wafer held on the X,Y stage.

10. The method for reducing wafer taper during single-wafer polishing as claimed in claim 6, wherein the wafer is pressed and polished on a polishing pad under a continuous supply of polishing slurry while the wafer turns about the center of the pressing load and the polishing pad rotates about its own center.

11. The method for reducing wafer taper during single-wafer polishing as claimed in claim 7, wherein the wafer is pressed and polished on a polishing pad under a continuous supply of polishing slurry while the wafer turns about the center of the pressing load and the polishing pad rotates about its own center.

12. The method for reducing wafer taper during single-wafer polishing as claimed in claim 8, wherein the wafer is pressed and polished on a polishing pad under a continuous supply of polishing slurry while the wafer turns about the center of the pressing load and the polishing pad rotates about its own center.

13. The method for reducing wafer taper during single-wafer polishing claimed in claim 9, wherein the wafer is pressed and polished on a polishing pad under a continuous supply of polishing slurry while the wafer turns about the center of the pressing load and the polishing pad rotates about its own center.

14. The method for reducing wafer taper during single-wafer polishing as claimed in claim 6, wherein the method of least squares is applied to calculate the taper T and stock removal $S_0$ from the thickness distribution of the wafer.

15. The method for reducing wafer taper during single-wafer polishing as claimed in claim 7, wherein the method of least squares is applied to calculate the taper T and stock removal $S_0$ from the thickness distribution of the wafer.

16. The method for reducing wafer taper during single-wafer polishing as claimed in claim 8, wherein the method of least squares is applied to calculate the taper T and stock removal $S_0$ from the thickness distribution of the wafer.

17. The method for reducing wafer taper during single-wafer polishing as claimed in claim 9, wherein the method of least squares is applied to calculate the taper T and stock removal $S_0$ from the thickness distribution of the wafer.

* * * * *